US010786037B2

(12) United States Patent
Bunnell et al.

(10) Patent No.: US 10,786,037 B2
(45) Date of Patent: Sep. 29, 2020

(54) SOLE STRUCTURE FOR AN ARTICLE OF FOOTWEAR WITH SIDE WALL NOTCH AND NONLINEAR BENDING STIFFNESS

(71) Applicant: NIKE, Inc., Beaverton, OR (US)

(72) Inventors: Dennis D. Bunnell, Vancouver, WA (US); Austin Orand, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 323 days.

(21) Appl. No.: 15/423,882

(22) Filed: Feb. 3, 2017

(65) Prior Publication Data

US 2017/0224051 A1 Aug. 10, 2017

Related U.S. Application Data

(60) Provisional application No. 62/293,085, filed on Feb. 9, 2016.

(51) Int. Cl.

| | |
|---|---|
| ***A43B 13/14*** | (2006.01) |
| ***A43B 13/18*** | (2006.01) |
| ***A43B 13/02*** | (2006.01) |
| ***A43B 13/04*** | (2006.01) |
| ***A43B 13/16*** | (2006.01) |

(52) U.S. Cl.

CPC ..... *A43B 13/141* (2013.01); *A43B 13/026* (2013.01); *A43B 13/04* (2013.01); *A43B 13/14* (2013.01); *A43B 13/16* (2013.01); *A43B 13/181* (2013.01)

(58) Field of Classification Search

CPC ..... A43B 13/141; A43B 13/16; A43B 13/04; A43B 13/026; A43B 13/223

See application file for complete search history.

(56) References Cited

U.S. PATENT DOCUMENTS

| | | | | |
|---|---|---|---|---|
| 4,615,126 A * | 10/1986 | Mathews | ..... | A43B 5/06 36/102 |
| 7,665,229 B2 | 2/2010 | Kilgore et al. | | |
| 7,849,609 B2 | 12/2010 | Edington et al. | | |
| 8,001,704 B2 * | 8/2011 | Baudouin | ..... | A43B 7/1495 36/102 |

(Continued)

FOREIGN PATENT DOCUMENTS

| | | |
|---|---|---|
| CA | 1151866 A | 8/1983 |
| WO | 2011149581 A1 | 12/2011 |

OTHER PUBLICATIONS

Tim Newcomb, Patrick Peterson, Under Armour unveil bra-like fit in latest football cleats, http://si.com/edge/2015/02/19/patrick-peterson-under-armour-unveil-bra-fit-football-cleat, Feb. 19, 2015.

*Primary Examiner* — Katharine Gracz
(74) *Attorney, Agent, or Firm* — Quinn IP Law

(57) ABSTRACT

A sole structure for an article of footwear comprises a sole plate that includes a forefoot portion with a foot-facing surface. The sole plate has at least one side wall extending upward from the foot-facing surface. The at least one side wall has a first notch in an upper periphery of the side wall in the forefoot portion. The first notch is configured to be open when the forefoot portion of the sole plate is dorsiflexed in a first portion of a flexion range and closed when the forefoot portion of the sole plate is dorsiflexed in a second portion of the flexion range greater than the first portion.

16 Claims, 11 Drawing Sheets

(56) References Cited

U.S. PATENT DOCUMENTS

2007/0039208 A1* 2/2007 Bove ..... A43B 3/26 36/97
2007/0113426 A1* 5/2007 Abadjian ..... A43B 5/00 36/29
2007/0240332 A1* 10/2007 Ellis, III ..... A43B 13/141 36/30 R
2008/0052960 A1* 3/2008 Belley ..... A43B 13/125 36/50.1
2008/0184592 A1* 8/2008 Brie ..... A43B 3/16 36/7.1 R
2009/0090027 A1* 4/2009 Baudouin ..... A43B 7/1495 36/93
2009/0100718 A1 4/2009 Gerber
2011/0277350 A1* 11/2011 Huynh ..... A43B 13/141 36/102
2011/0289742 A1* 12/2011 Yen ..... A43C 1/04 24/68 SK
2012/0167416 A1* 7/2012 Christensen ..... A43B 3/0057 36/103
2012/0233886 A1* 9/2012 Madore ..... A43B 13/141 36/103
2013/0247425 A1* 9/2013 Davis ..... A43B 13/02 36/30 R
2014/0013624 A1* 1/2014 Stockbridge ..... A43B 13/00 36/103
2014/0026441 A1* 1/2014 Stauffer ..... A43C 15/00 36/103
2014/0223779 A1* 8/2014 Elder ..... A43C 1/04 36/103
2014/0250723 A1 9/2014 Kohatsu
2014/0305006 A1* 10/2014 Azoulay ..... A43B 11/00 36/84
2015/0089841 A1* 4/2015 Smaldone ..... A43B 5/00 36/103
2015/0173456 A1 6/2015 Rushbrook
2016/0021974 A1* 1/2016 Schindler ..... A43B 13/223 36/103
2016/0360828 A1* 12/2016 Guyan ..... A43B 13/186
2017/0079373 A1* 3/2017 Huard ..... A43B 13/026
2017/0079375 A1 3/2017 Bunnell et al.

* cited by examiner

SOLE STRUCTURE FOR AN ARTICLE OF FOOTWEAR WITH SIDE WALL NOTCH AND NONLINEAR BENDING STIFFNESS

CROSS-REFERENCE TO RELATED APPLICATION

This application claims the benefit of priority to U.S. Provisional Application No. 62/293,085 filed Feb. 9, 2016, which is hereby incorporated by reference in its entirety.

TECHNICAL FIELD

The present teachings generally include a sole structure for an article of footwear.

BACKGROUND

Footwear typically includes a sole structure configured to be located under a wearer's foot to space the foot away from the ground. Sole assemblies in athletic footwear are configured to provide desired cushioning, motion control, and resiliency.

DESCRIPTION

Figure 1:
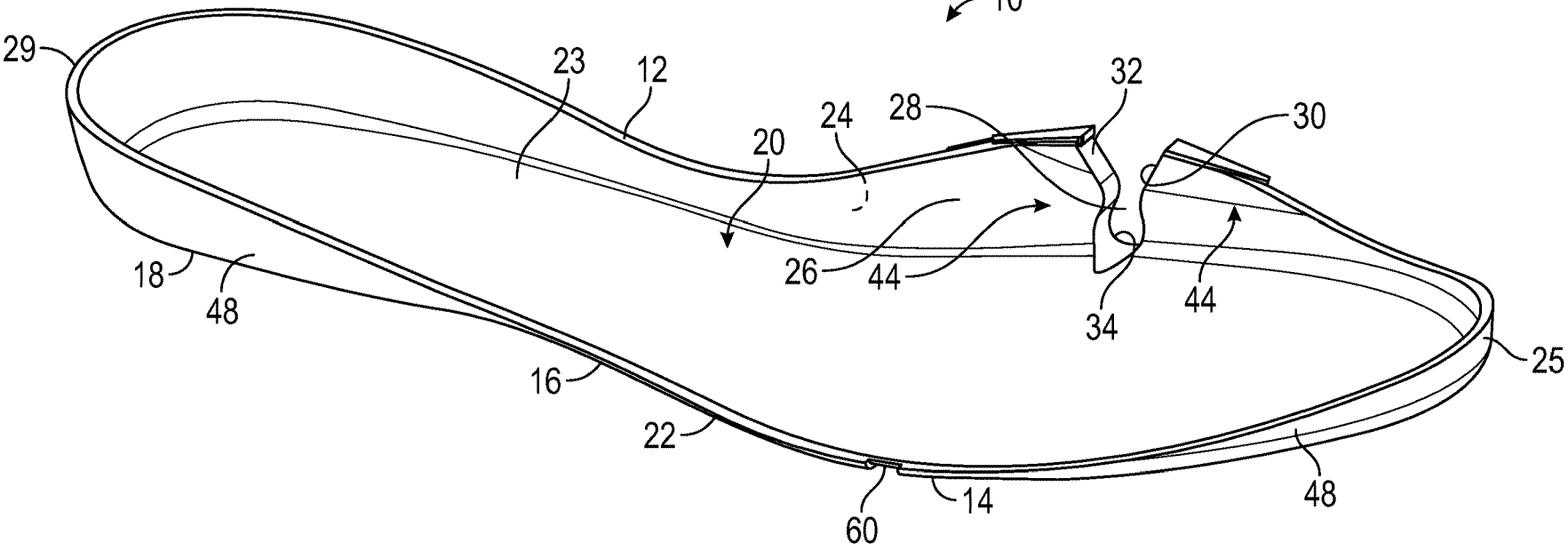
FIG. 1 is a schematic perspective illustration of a first embodiment of a sole structure for an article of footwear.

A sole structure for an article of footwear comprises a sole plate that includes a forefoot portion with a foot-facing surface. The sole plate may be a unisole plate, an inner board plate, an outsole plate, a midsole plate, or any combination of an inner board plate, an outsole plate, and a midsole plate.

The sole plate has at least one side wall extending upward from the foot-facing surface. The at least one side wall has a notch in an upper periphery of the side wall in the forefoot portion. The notch is configured to be open when the forefoot portion of the sole plate is dorsiflexed in a first portion of a flexion range and closed when the forefoot portion of the sole plate is dorsiflexed in a second portion of the flexion range greater than the first portion. The notch has a forward face and a rearward face that are non-parallel and spaced apart from one another when the sole plate is in an unflexed, relaxed state, and that are parallel and in contact with one another when the sole plate is dorsiflexed in the longitudinal direction in the second portion of the flexion range.

In an embodiment, the first portion of the flexion range includes flex angles of the sole plate less than a first predetermined flex angle, and the second portion of the sole plate includes flex angles of the sole plate greater than or equal to the first predetermined flex angle. The closing of the notch increases resistance to flexion of the sole plate, and the sole plate provides a change in bending stiffness, with a greater bending stiffness in the second portion of the flexion range than in the first portion of the flexion range.

In an embodiment, the at least one side wall may be at a medial side of the sole plate and the notch may be the only notch in the forefoot portion of the at least one side wall. Alternatively, the at least one side wall may be at the lateral side of the sole plate, and the notch may be the only notch in the forefoot portion of the at least one side wall. Still further, both the medial side wall and the lateral side wall may have one or more notches in the forefoot portion.

In an embodiment, the forward face of the notch inclines in a forward direction, and the rearward face of the notch inclines a rearward direction when the sole plate is in the unflexed, relaxed state.

In an embodiment, the notch may have a rounded base connecting a forward face and a rearward face of the notch. The notch is open at the rounded base both when the forward face and the rearward face are spaced apart from one another (i.e., when the notch is open), and when the forward face and the rearward face are in contact with one another (i.e., when the notch is closed). Stated differently, the notch has a rounded base disposed between the forward face and the rearward face, and the notch is open at the rounded base in both the first portion of the flexion range and the second portion of the flexion range.

A height of a forefoot portion of the at least one side wall may be greatest at the first notch. The forefoot portion of the upper periphery of the at least one side wall may have a first peak at the forward face, and a second peak at the rearward face. The at least one side wall may taper in height from the first peak in a forward direction, and taper in height from the second peak in a rearward direction.

In an embodiment, a forward flange extends along the forward face, and a rearward flange extends along the rearward face. The forward flange and the rearward flange are thicker than a portion of the at least one side wall adjacent the forward flange and the rearward flange.

Optionally, a ground-facing surface of the sole plate opposite from the foot-facing surface may include a flex groove that extends generally transversely in the ground-facing surface toward the notch.

Still further, the sole plate may have at least one rib at a surface of the at least one side wall. The at least one rib may extend generally downward from the upper periphery of the at least one side wall and may be adjacent to the notch.

In an embodiment, a sole structure for an article of footwear comprises a sole plate that includes a forefoot portion with a foot-facing surface. The sole plate has at least one side wall extending upward from the foot-facing surface. The at least one side wall has a first notch in an upper periphery of the at least one side wall in the forefoot portion of the sole plate. The first notch includes a rounded base and extends from the upper periphery to the rounded base. The first notch is configured to be open between the upper periphery and the rounded base when the forefoot portion of the sole plate is dorsiflexed in a first portion of a flexion range and closed between the upper periphery and the rounded base when the forefoot portion of the sole plate is dorsiflexed in a second portion of the flexion range greater than the first portion. The first notch is open at the rounded base in both the first portion of the flexion range and the second portion of the flexion range.

In an embodiment, the at least one side wall includes a medial side wall at a medial side of the sole plate and a lateral side wall at a lateral side of the sole plate. The first notch is in the medial side wall. The lateral side wall has at least one notch in an upper periphery of the lateral side wall in the forefoot portion of the sole plate.

In an embodiment, the medial side wall has a second notch in the upper periphery of the medial side wall in the forefoot portion of the sole plate anterior to the first notch. The lateral side wall has two notches in the upper periphery of the lateral side wall in the forefoot portion of the sole plate.

In an embodiment, a ground-facing surface of the sole plate has a flex groove extending generally transversely in the ground-facing surface toward the first notch.

In an embodiment, a height of a forefoot portion of the at least one side wall is greatest at the notch.

The above features and advantages and other features and advantages of the present teachings are readily apparent from the following detailed description of the modes for carrying out the present teachings when taken in connection with the accompanying drawings.

Figure 2:
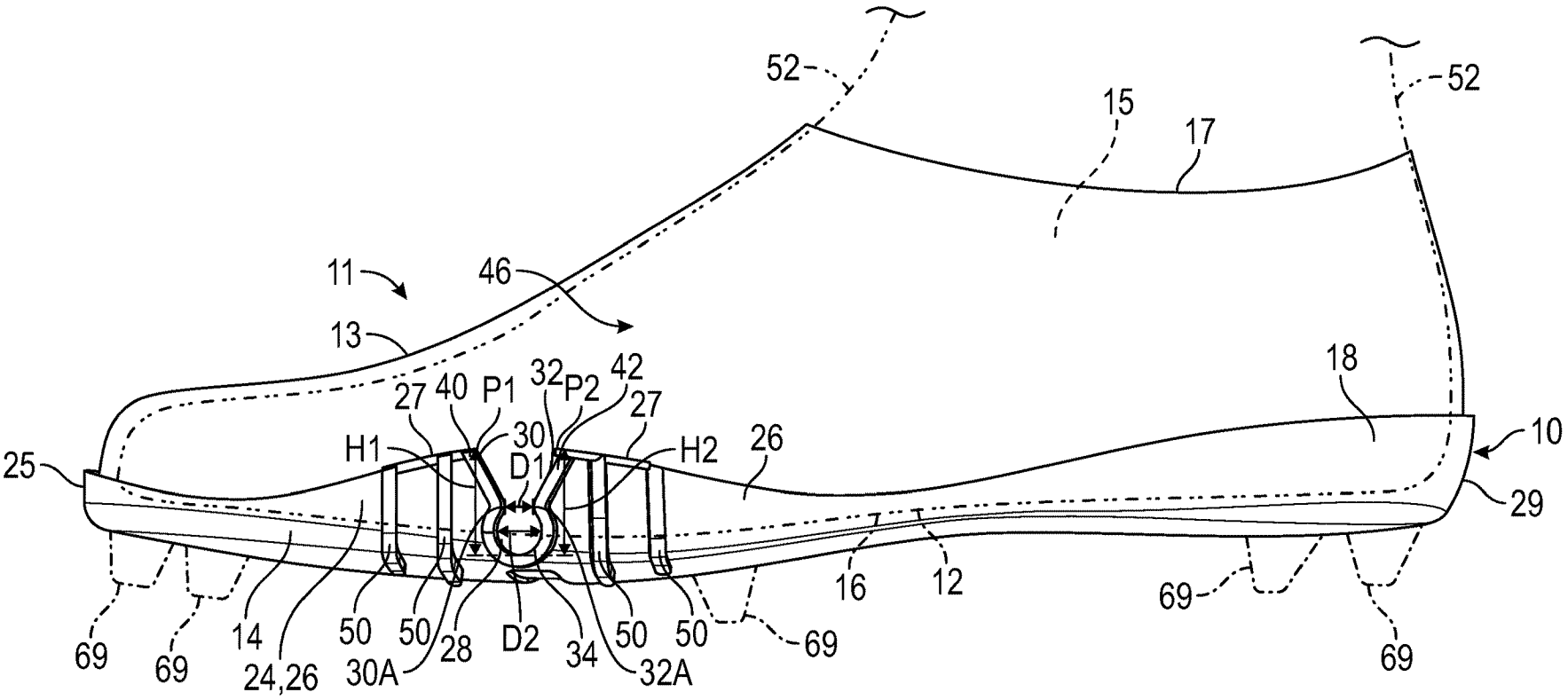
FIG. 2 is a schematic illustration in medial side view of the sole structure of FIG. 1 with an upper and showing a foot in phantom.

Referring to the drawings, wherein like reference numbers refer to like components throughout the views, FIG. 1 shows a sole structure 10 for an article of footwear 11 shown in FIG. 2. The sole structure 10 has a resistance to flexion that increases with increasing dorsiflexion of the forefoot portion 14 of the sole structure 10 (i.e., flexing of the forefoot portion 14 in the longitudinal direction as discussed herein). As further explained herein, due to a notch 28 provided in side wall 26, the sole structure 10 (and more specifically the sole plate 12 described herein), provides an increase in bending stiffness when flexed in a longitudinal direction at one or more predetermined flex angles. More particularly, the sole structure 10 has a bending stiffness that is a piecewise function with a change at a first predetermined flex angle. The bending stiffness is tuned by the selection of various structural parameters discussed herein that determine the first predetermined flex angle. As used herein, "bending stiffness" and "bend stiffness" may be used interchangeably.

Referring to FIGS. 1 and 2, the sole structure 10 includes a sole plate 12, and may include one or more additional plates, layers, or components, as discussed herein. The article of footwear 11 includes an upper 13 (shown in FIG. 2). The sole plate 12 is configured to be operatively connected to the upper 13 as discussed herein. The upper 13 may incorporate a plurality of material elements (e.g., textiles, foam, leather, and synthetic leather) that are stitched or adhesively bonded together to form an interior void 15 for securely and comfortably receiving a foot 52 as shown. The material elements may be selected and located with respect to upper 13 in order to selectively impart properties of durability, air-permeability, wear-resistance, flexibility, and comfort, for example. An ankle opening 17 provides access to the interior void 15. In addition, upper 13 may include a lace or other tightening mechanism that is utilized to modify the dimensions of the interior void 15, thereby securing the foot 52 within the interior void 15 and facilitating entry and removal of the foot 52 from the interior void 15. For example, a lace may extend through apertures in upper 13, and a tongue portion of upper 13 may extend between the interior void 15 and the lace. The upper 13 may exhibit the general configuration discussed above or a different configuration. Accordingly, the structure of the upper 13 may vary significantly within the scope of the present teachings.

Sole structure 10 is secured to the upper 13 and has a configuration that extends between the upper 13 and the ground G. In addition to attenuating ground reaction forces (i.e., providing cushioning for the foot), the sole structure 10 may provide traction, impart stability, and limit various foot motions.

In the embodiment shown, the sole plate 12 is a full-length, unitary sole plate 12 that has a forefoot portion 14, a midfoot portion 16, and a heel portion 18 which may also be referred to respectively as a forefoot region 14, a midfoot region 16, and a heel region 18. The sole plate 12 provides a foot-receiving surface 20 (also referred to as a foot-facing surface) that extends over the forefoot portion 14, the midfoot portion 16, and the heel portion 18. In other embodiments, the sole plate 12 may be a partial length plate member. For example, in some cases, the sole plate 12 may include only a forefoot portion that may be operatively connected to other components of the article of footwear that comprise a midfoot portion and a heel portion.

The heel portion 18 generally includes the region of the sole plate 12 corresponding with the rear portion of a human foot, including the calcaneus bone, when the human foot is supported on the sole structure 10 and is a size corresponding with the sole structure 10. The forefoot portion 14 generally includes the region of the sole plate 12 corresponding with the toes and the joints connecting the metatarsal bones with the phalange bones of the human foot (interchangeably referred to herein as the "metatarsal-phalangeal joints" or "MPJ" joints). The midfoot portion 16 generally includes the region of the sole plate 12 corresponding with an arch area of the human foot, including the navicular joint. Portions 14, 16, 18 are not intended to demarcate precise areas of the sole structure 10. Rather, portions 14, 16, 18 are intended to represent general areas relative to one another, to aid in the following discussion. As shown, the sole plate 12 extends from a lateral side 22 to a medial side 24. As used herein, a lateral side of a component for an article of footwear, including the lateral side 22 of the sole plate 12, is a side that corresponds with an outside area of the human foot 52 (i.e., the side closer to the fifth toe of the wearer). The fifth toe is commonly referred to as the little toe. A medial side of a component for an article of footwear, including the medial side 24 of the sole plate 12, is the side that corresponds with an inside area of the human foot 52 (i.e., the side closer to the hallux of the foot of the wearer). The hallux is commonly referred to as the big toe. Both the lateral side 22 and the medial side 24 extend from a foremost extent 25 to a rearmost extent 29 of a periphery of the sole plate 12. In the embodiment shown, the medial side 24 is established by side wall 26, which varies in height. The lateral side 22 is established by side wall 48, which tapers to minimal or no height in the forefoot portion 14 generally under the MPJ joints of the foot 52. These descriptions of the relative positions of a heel portion, a midfoot portion, a forefoot portion, a medial side, and a lateral side may also be used to describe portions of the article of footwear 11, including the sole structure, and individual components thereof.

The sole plate 12 is referred to as a plate, but is not necessarily flat and need not be a single component but instead can be multiple interconnected components. For example, both an upward-facing portion of the foot-facing surface 20 and the opposite ground-facing surface 21 may be pre-formed with some amount of curvature and variations in thickness when molded or otherwise formed in order to provide a shaped footbed and/or increased thickness for reinforcement in desired areas. For example, the sole plate 12 could have a curved or contoured geometry that may be similar to the lower contours of the foot 52. In the example shown, the sole plate 12 includes the side walls as a contoured periphery that slope upward toward any overlaying layers, such as a midsole component or the upper 13. The side walls 26, 48 extend upward around a periphery of a generally upward-facing bottom portion 23 of the foot-facing surface 20. The side walls 26, 48 may be a single, unitary component with the bottom portion 23, or these may each be separate components operatively connected to one another such as with adhesive or by thermal bonding.

The sole plate 12 may be entirely of a single, uniform material, or may have different portions comprising different materials. For example, a first material of the forefoot portion 14 can be selected to achieve, in conjunction with the parameters of the side walls 26, 48, the desired bending stiffness in the forefoot portion 14, while a second material of the midfoot portion 16 and the heel portion 18 can be a different material that has little effect on the bending stiffness of the forefoot portion 14 at the notch 28. By way of non-limiting example, the second portion can be overmolded on or co-injection molded with the first portion. Example materials for the sole plate 12 include durable, wear resistant materials such as but not limited to nylon, thermoplastic polyurethane, or carbon fiber.

The term "longitudinal," as used herein, refers to a direction extending along a length of the sole structure 10, e.g., extending from the forefoot portion 14 to the heel portion 18 of the sole structure 10. The term "forward" is used to refer to the general direction from the heel portion 18 toward the forefoot portion 14, and the term "rearward" is used to refer to the opposite direction, i.e., the direction from the forefoot portion 14 toward the heel portion 18. The term "anterior" is used to refer to a front or forward component or portion of a component. The term "posterior" is used to refer to a rear or rearward component or portion of a component.

Figure 5:
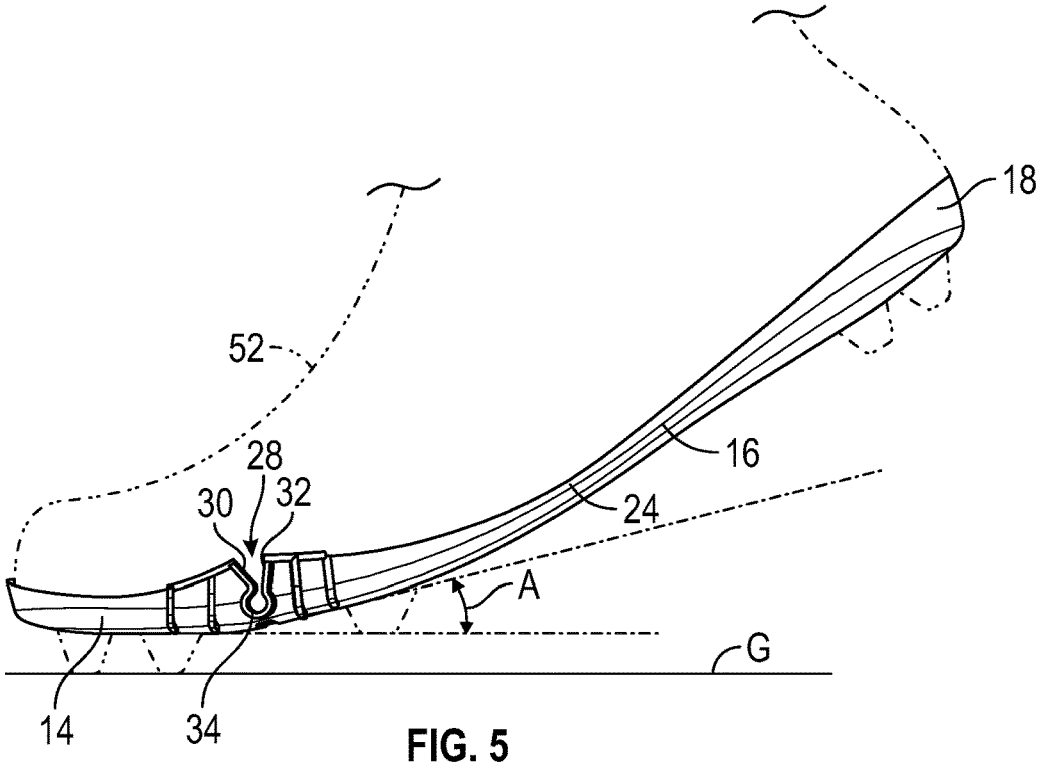
FIG. 5 is a schematic illustration in medial side view of the sole structure of FIG. 1, flexed in a first portion of a range of flexion.

As shown in FIGS. 2 and 5, a foot 52 can be supported by the foot-facing surface 20, with the foot 52 above the foot-facing surface 20. The foot-facing surface 20 may be referred to as a foot-receiving surface or an upper surface or upward-facing surface of the sole plate 12. The foot-facing surface 20 supports the foot 52 but need not be in contact with the foot 52. For example, an insole, midsole, strobel, or other layers or components may be positioned between the foot 52 and the foot-facing surface 20.

In the embodiment shown, the sole plate 12 may be an inner board plate, also referred to as an inner board, an insole board, or a lasting board. In other embodiments, the sole plate 12 may be an outsole. Still further, the sole plate 12 could be a midsole plate or a unisole plate, or may be any combination of an inner board plate, a midsole plate, or an outsole.

The sole plate 12 has at least one notch 28 that affects the bending stiffness of the sole structure 10. Stated differently, the side wall 26 of the sole plate 12 defines a first notch 28. The notch 28 extends downward from an upper periphery 27 of the side wall 26 toward the foot-facing surface 20. The notch 28 is configured to be open when the forefoot portion 14 of the sole plate 12 and the sole structure 10 is dorsiflexed in a first portion of a flexion range (i.e., at flex angles less than a first predetermined flex angle A1 (indicated in FIG. 6)), and closed when the forefoot portion 14 is dorsiflexed in a second portion of the flexion range greater than the first portion (i.e., at flex angles such as flex angle A that are greater than or equal to the first predetermined flex angle A1). The first predetermined flex angle A1 is defined as the angle formed at the intersection between a first axis LM1 and a second axis LM2 where the first axis generally extends along a longitudinal midline LM at a ground-facing surface 21 of sole plate 12 (best shown in FIG. 4) anterior to the side wall notch 28, and the second axis LM2 generally extends along the longitudinal midline LM at the ground-facing surface 21 of the sole plate 12 posterior to the side wall notch 28. The sole plate 12 is configured so that the intersection of the first and second axes LM1 and LM2 will typically be approximately centered both longitudinally and transversely below the side wall notch 28 discussed herein, and below the metatarsal-phalangeal joints of the foot 52 supported on the foot-facing surface 20.

By way of non-limiting example, the first predetermined flex angle A1 may be from about 30 degrees to about 65 degrees. In one exemplary embodiment, the first predetermined flex angle A1 is found in the range of between about 30 degrees and about 60 degrees, with a typical value of about 55 degrees. In another exemplary embodiment, the first predetermined flex angle A1 is found in the range of between about 15 degrees and about 30 degrees, with a typical value of about 25 degrees. In another example, the first predetermined flex angle A1 is found in the range of between about 20 degrees and about 40 degrees, with a typical value of about 30 degrees. Generally, the specific flex angle or range of angles at which a change in the rate of increase in bending stiffness occurs is dependent upon the specific activity for which the article of footwear is designed.

Figure 7:
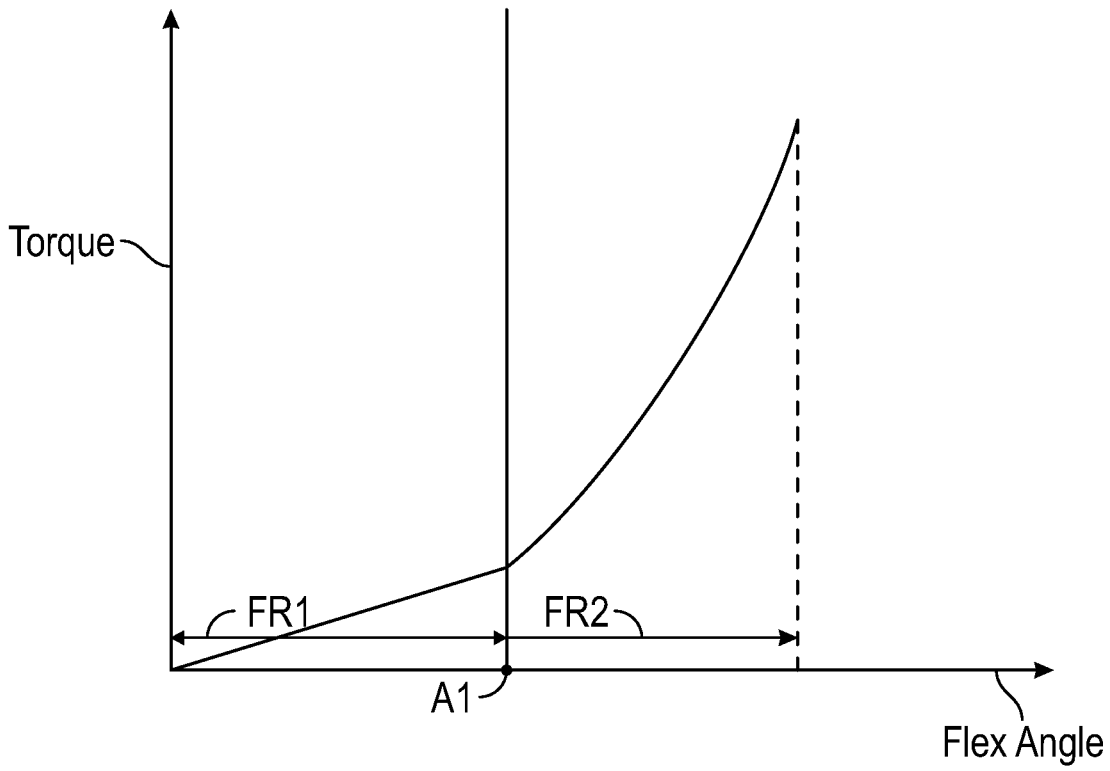
FIG. 7 is a plot of torque versus flex angle for the sole structure of FIGS. 1-6.

As an ordinarily skilled artisan will recognize in view of the present disclosure, a sole plate 12 will bend in dorsiflexion in response to forces applied by corresponding bending of a user's foot at the MPJ during physical activity. Throughout the first portion of the flexion range FR1, the bending stiffness (defined as the change in moment as a function of the change in angle) will remain approximately the same as bending progresses through increasing angles of flexion. Because bending within the first portion of the flexion range FR1 is primarily governed by inherent material properties of the materials of the plate, a graph of torque on the plate versus angle of flexion (the slope of which is the bending stiffness) in the first portion of the flexion range FR1 will typically demonstrate a smoothly but relatively gradually inclining curve (referred to herein as a "linear" region with constant bending stiffness). At the boundary between the first and second portions of the range of flexion, however, the closure of the notch 28 engages additional material and mechanical properties that exert a notable increase in resistance to further dorsiflexion. Therefore, a corresponding graph of torque versus angle of deflection (the slope of which is the bending stiffness) that also includes the second portion of the flexion range FR2 would show—beginning at an angle of flexion approximately corresponding to angle A1—a departure from the gradually and smoothly inclining curve characteristic of the first portion of the flexion range FR1. This departure is referred to herein as a "nonlinear" increase in bend stiffness, and would manifest as either or both of a stepwise increase in bending stiffness and/or a change in the rate of increase in the bending stiffness. The change in rate can be either abrupt, or it can manifest over a short range of increase in the bend angle of the sole plate 12. In either case, a mathematical function describing a bending stiffness in the second portion of the flexion range FR2 will differ from a mathematical function describing bending stiffness in the first portion of the flexion range. FIG. 7 is an example plot depicting an expected increase in resistance to flexion at increasing flex angles, as exhibited by the increasing magnitude of torque required at the heel portion 18 for dorsiflexion of the forefoot portion 14. The bending stiffness in the first range of flexion FR1 may be constant (thus the plot would have a linear slope) or substantially linear or may increase gradually (which would show a change in slope in FR1). The bending stiffness in the second range of flexion FR2 may be linear or nonlinear, but will depart from the bending stiffness of the first range of flexion FR1 at the first predetermined flex angle A1, either markedly or gradually (such as over a range of several degrees) at the first predetermined flex angle A1 due to the closing of the notch 28.

As will be understood by those skilled in the art, during bending of the sole plate 12 as the foot 52 is dorsiflexed, there is a layer in the sole plate 12 referred to as a neutral plane (although not necessarily planar) or neutral axis above which the sole plate 12 is in compression, and below which the sole plate 12 is in tension. The closing of the side wall notch 28 places additional compressive forces on the sole plate 12 above the neutral plane, and additional tensile forces below the neutral plane, nearer the ground-facing surface 21, as indicated by tensile forces TF2 in FIG. 6. In addition to the mechanical (e.g., tensile, compression, etc.) properties of the sole plate 12, structural factors that likewise affect changes in bending stiffness during dorsiflexion include but are not limited to the thicknesses, the longitudinal lengths, and the medial-lateral widths of different portions of the sole plate 12.

Figure 6:
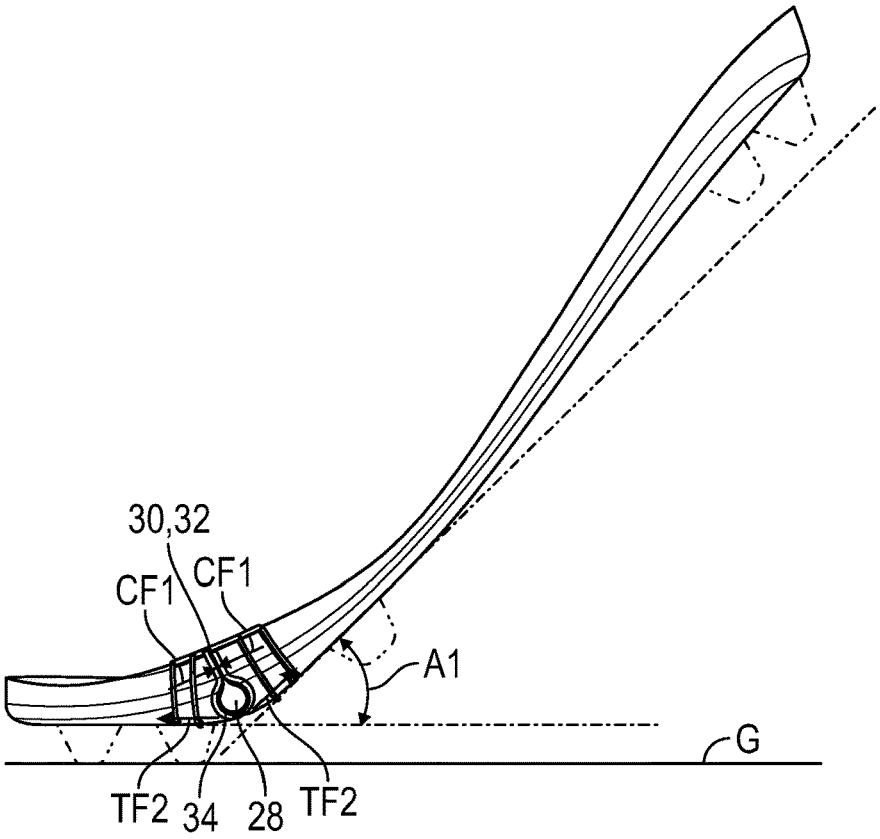
FIG. 6 is a schematic illustration in medial side view of the sole structure of FIG. 5 flexed at a first predetermined flex angle.

When the flex angle of the sole plate 12 reaches the predetermined flex angle A1, the faces 30, 32 of the side wall 26 at the notch 28 contact one another and the side wall notch 28 closes. Throughout any further dorsiflexion, neither of the faces 30, 32 is able to move further toward the other. Therefore, as the sole plate 12 bends further, compressive forces CF1 due to the bending of the sole plate 12 are applied across the closed notch 28, as shown in FIG. 6. Bending stiffness of the forefoot portion 14 in the first portion of the flexion range FR1 is influenced mainly by the portion of the sole plate 12 below the open notch 28 (i.e., the bottom portion 23), while bending stiffness of the forefoot portion 14 in the second portion of the flexion range FR2 is influenced by the full height of the side wall 26 at the closed notch 28. As further discussed herein and as shown in FIG. 6, the notch 28 closes when a forward face 30 of the side wall 26 at the notch 28 (referred to as a forward face of the notch 28) is in contact with a rearward face 32 of the side wall 26 at the notch 28 (referred to as a rearward face of the of the notch 28). The side wall 26 is configured so that the notch 28 is positioned directly laterally outward of a wearer's metatarsal-phalangeal joints (i.e., of the foot 52) based on population averages for the particular size of footwear.

In the embodiment shown in FIG. 1, the notch 28 is in the side wall 26 at the medial side 24 of the sole structure 10 and is the only notch in the forefoot portion 14 of the side wall 26. The side wall 48 on the lateral side 22 generally decreases in height from the rearmost extent 29 of the heel portion 18 and from the foremost extent 25 of the forefoot portion 14 to a minimal height or no height generally transverse from the notch 28 and underlying the MPJ joints. By configuring the lateral side wall 48 to have a minimal height or no height transverse from the notch 28, the side wall 48 does not interfere with or affect the bending in the forefoot portion 14 due to flexing of the MPJ joints. In other embodiments, the lateral side wall 48 could have a greater height and have one or more notches in the forefoot portion 14, and/or the medial side wall 26 could have more than one notch.

Figure 3:
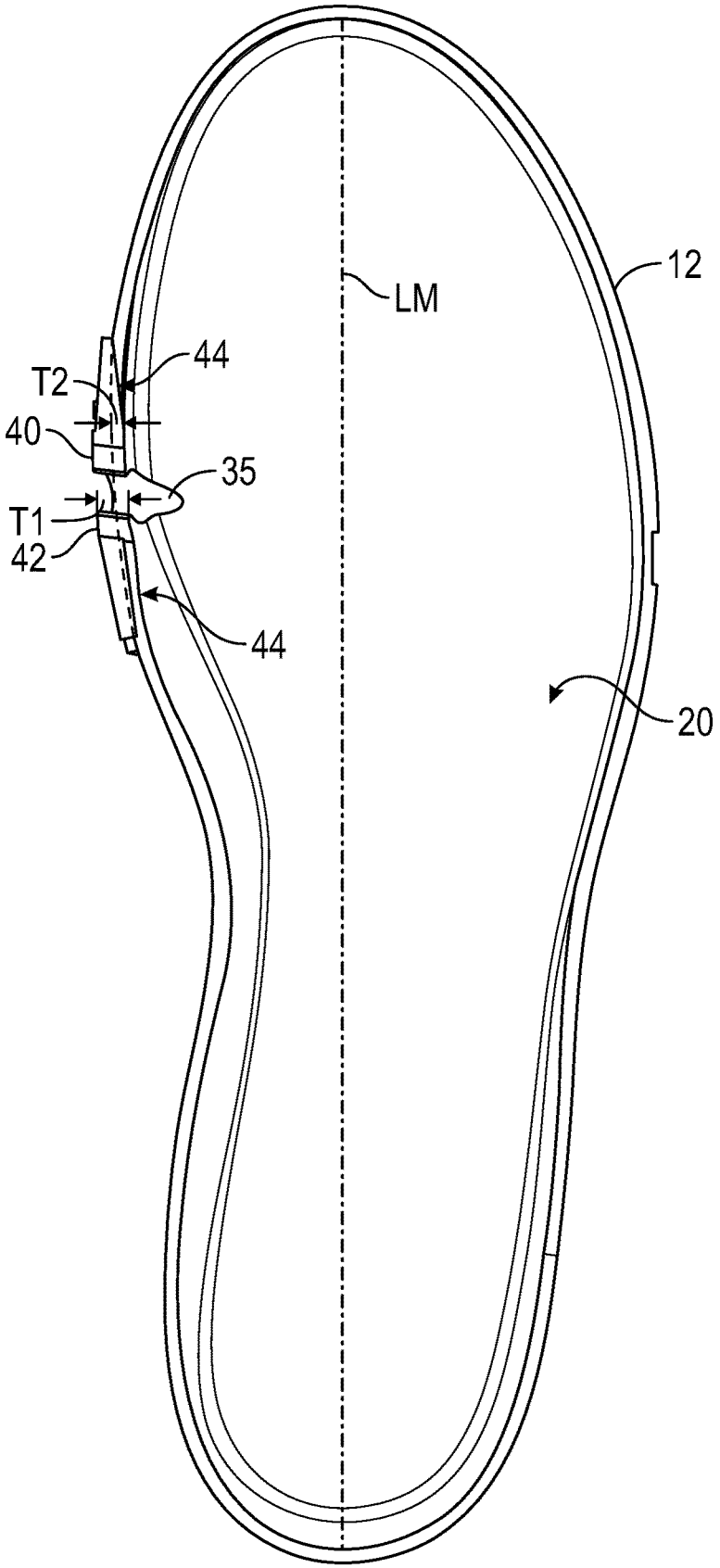
FIG. 3 is a schematic illustration in plan view of the sole structure of FIG. 1.

The notch 28 has a rounded base 34 that connects the forward face 30 and the rearward face 32, referred to as a rounded base 34 of the notch 28. The rounded base 34 is configured to remain open both when the sole structure 10 and sole plate 12 are in a relaxed, unflexed state, as shown in FIG. 2 (i.e., when the notch 28 is open), and even when the notch 28 is closed (i.e., when the forward face 30 is in contact with the rearward face 32 due to the sole structure 10 (including the sole plate 12) being flexed at a flex angle greater than or equal to the first predetermined flex angle A1). There is still an opening in the side wall 26 at the rounded base 34 even when the forward face 30 is in contact with the rearward face 32, as shown in FIG. 6. As shown in FIG. 2, a distance D1 across the notch 28 between a lowest extremity 30A of the forward face 30 and a lowest extremity 32A of the rearward face 32 when the sole plate 12 is in the unflexed, relaxed state is less than a distance D2 across the notch 28 at the rounded base 34 below the lowest extremity 30A of the forward face 30 and the lowest extremity 32A of the rearward face 32. As used herein, the "lowest extremity" of the forward face 30A is the end of the face 30 closest to the rounded base 34 of the notch 28 as opposed to the end of the forward face 30 at the first peak P1. Similarly, the "lowest extremity" of the rearward face 32 is the end of the face 32 closest to the rounded base 34 of the notch 28 as opposed to the end of the rearward face 32 at the second peak P2. This configuration of the notch 28 with the rounded base 34 helps to minimize stress concentrations. In other words, bending of the sole plate 12 occurs along an expanse of the sole plate 12 below the notch 28 to the lowest height of the lateral side wall 48, spread along the rounded base 34, rather than at a more discreet hinge point. As shown in FIG. 3, a groove 35 extends from the rounded base 34 in the foot-facing surface 20 generally transversely from the first notch 28. As used herein, a feature extends generally transversely when it extends lengthwise at least partially transversely. The groove 35 is a slight recess in the foot-facing surface 20 and extends toward the longitudinal midline LM. The groove 35 promotes flexing of the side wall 26 at the bottom of the rounded base 34, further promoting alignment of the flanges 40, 42 and decreasing stress concentrations below the rounded base 34.

As the foot 52 flexes by lifting the heel portion 18 away from the ground G while maintaining contact with the ground G at a forward portion of the article of footwear 11 corresponding with a forward portion of the forefoot portion 14, it places torque on the sole structure 10 and causes the sole plate 12 to flex at the forefoot portion 14. With the notch 28 open, and with no compressive forces therefore applied across the open notch 28, the bending stiffness of the sole structure 10 during the first range of flexion FR1 will be at least partially correlated with the height of the side wall below the notch 28, which is the thickness of the bottom portion 23 of the sole plate 12. The bending stiffness of the sole structure 10 during the second range of flexion FR2 will be at least partially correlated with the height of the side wall at the closed notch 28). The closed notch 28 provides increased bending stiffness.

Figure 4:
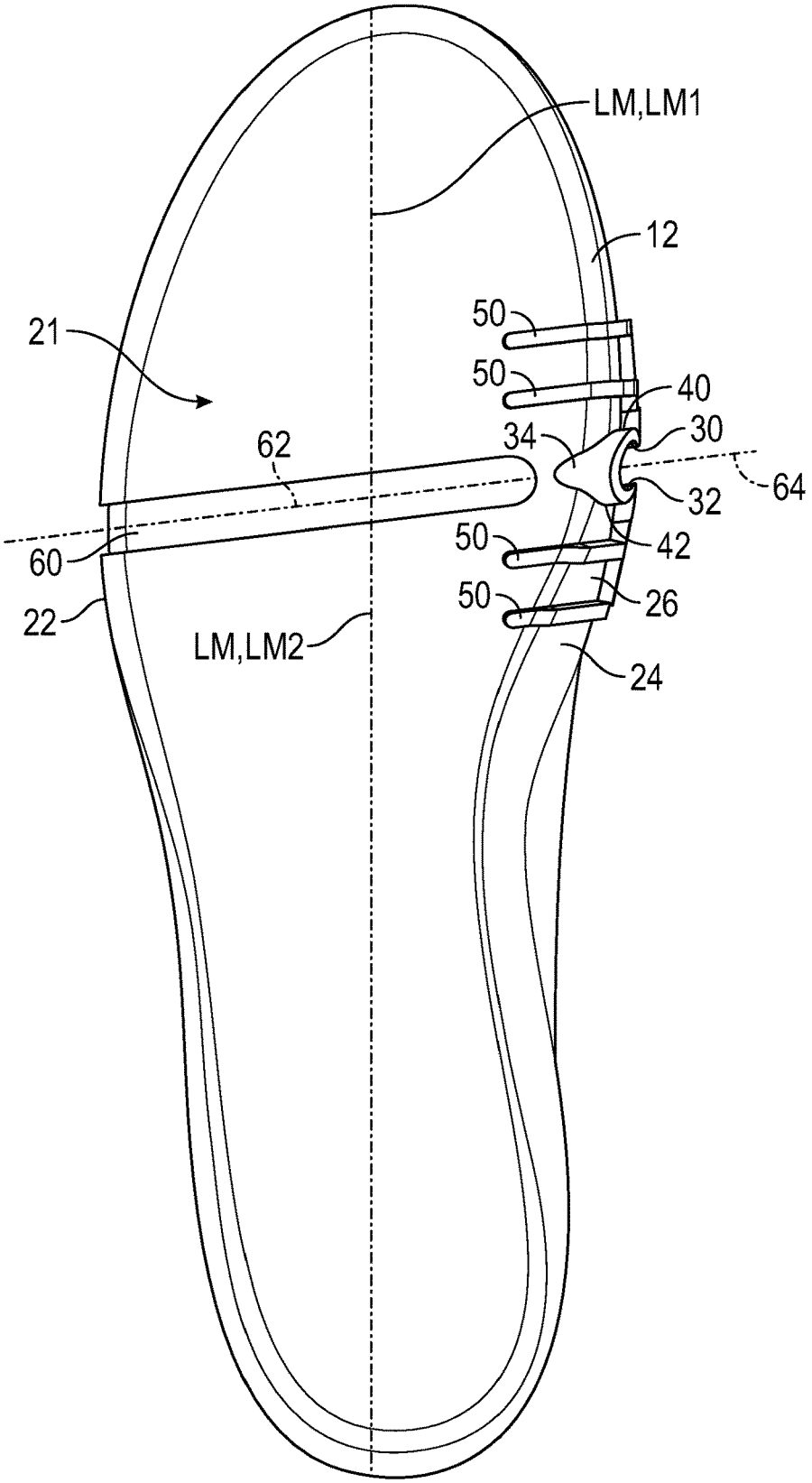
FIG. 4 is a schematic illustration in bottom view of the sole structure of FIG. 1.

In order to ensure that the forward face 30 and the rearward face 32 contact one another during dorsiflexion of the forefoot portion 14, and to minimize the possibility that relative lateral movement of the forward face 30 and rearward face 32 causes the faces 30, 32 to bypass one another partially or completely during dorsiflexion, the faces 30, 32 are provided with flanges. More specifically, the sole plate 12 has a forward flange 40 along the forward face 30 and a rearward flange 42 along the rearward face 32. As best illustrated in FIGS. 3 and 4, the flanges 40, 42 are thicker than the portion of the side wall 26 adjacent the flanges 40, 42. The flanges 40, 42 are shown with a thickness T1 that is greater than a thickness T2 of the adjacent portion of the side wall 26.

In addition to the thicker flanges 40, 42, the inner surface 44 of the side wall 26, indicated in FIG. 1, is operatively connected to an outer surface 46 of the upper 13, such as with adhesive or thermal bonding. The upper 13 is configured to be generally flexible in the vicinity of the notch 28 such that the upper 13 does not interfere with the movement of the faces 30, 32 into contact with one another.

At least one rib 50 may extend along an outer or inner surface of the side wall 26 generally downward from the upper periphery 27 toward the foot-facing surface 20 and adjacent the notch 28. As used herein, a feature extends generally downward when it extends at least partially downward. As shown in FIG. 4, the ribs 50 also extend partly along the ground-facing surface 21. In the embodiments shown, there are multiple ribs 50 on the outer surface of the side wall 26 and positioned both anterior to and posterior of the first notch 28 in the forefoot portion 14. In other embodiments, there may be only one rib 50 either anterior to or posterior of the notch in the forefoot portion 14. The ribs 50 brace the side wall 26 to prevent inward or outward bowing under the compressive forces CF1 across the closed notch 28. This helps to maintain alignment of the forward flange 40 and the rearward flange 42 with one another during dorsiflexion.

With reference to FIGS. 1 and 2, the forward face 30 of the first notch 28 inclines in a forward direction, the rearward face 32 of the first notch 28 inclines a rearward direction. The forward face 30 and the rearward face 32 are non-parallel and spaced apart from one another when the sole structure 10 including the sole plate 12 is in an unflexed, relaxed state, as shown in FIG. 2. The forward face 30 and the rearward face 32 are parallel and in contact with one another when the sole structure 10 including the sole plate 12 is flexed in the longitudinal direction to at least the first predetermined flex angle A1, i.e., in the second portion of the flexion range FR2, as illustrated in FIG. 6.

By configuring the sole plate 12 so that the forward and rearward faces 30, 32 and the accompanying flanges 40, 42 are nonparallel in the open position, surface area contact of the flanges 40, 42 is maximized when the notch 28 is closed. In such an embodiment, the entire planar surface area of the flanges 40, 42 can simultaneously come into contact when the notch 28 closes. In contrast, if the faces 30, 32 and flanges 40, 42 were parallel when the notch 28 was open, then the flanges 40, 42 would be non-parallel at least when the notch 28 initially closes, potentially resulting in a reduced contact area of the flanges 40, 42 and/or stress concentrations.

The relative inclinations of the forward face 30 and the rearward face 32 can be selected to provide a desired numerical value of the first predetermined flex angle, A1. Optionally, the notch 28 can be configured so that forward face 30 inclines forward more than rearward face 32 inclines rearward when the notch 28 is open and the sole plate 12 is in an unflexed position. The unflexed position is the position of the sole plate 12 when the heel portion 18 is not lifted and traction elements 69 at both the forefoot portion 14 and the heel portion 18 are in contact with the ground G. In FIG. 2, the sole structure 10 is shown in an unflexed position at a flex angle of 0 degrees.

The relative inclinations of the faces 30, 32 affects the angle at which the notch 28 closes (i.e., the numerical value of the first predetermined flex angle A1). A greater inclination of the forward face 30 in the forward direction and/or the rearward face 32 in the rearward direction ensures that the notch 28 closes at a greater first predetermined flex angle A1 than otherwise.

The height of the side wall 26 at the notch 28 also enhances the function of the notch 28 to increase the bending stiffness in a nonlinear manner. The height of the forefoot portion 14 of the side wall 26 forward of the notch 28 is less than the height H1 at the notch 28, i.e., at a first peak P1 formed by the meeting of the forward face 30 and the upper periphery 27. The height of the forefoot portion 14 of the side wall 26 rearward of the notch 28 is less than the height H2 at the notch 28, (i.e., at a second peak P2 formed by the meeting of the rearward face 32 with the upper periphery 27. The heights H1, H2 are measured from the bottom of the notch 28 at the base 34 to the respective peaks P1, P2. In the embodiment shown, the heights H1 and H2 are equal. The side wall 26 tapers in height from the first peak P1 in a forward direction (i.e., generally toward the foremost extent 25), and tapers in height from the second peak P2 in a rearward direction (i.e., generally toward the rearmost extent 29). The greater height at the notch 28 enables the forward face 30 and the rearward face 32 to have a greater length, spreading the compressive forces CF1 across the greater length of the faces 30, 32 and associated greater area of the flanges 40, 42.

As best shown in FIG. 4, the ground-facing surface 21 of the sole plate 12 includes a flex groove 60 that extends generally transversely in the ground-facing surface 21 toward the first notch 28. In the embodiment shown, the flex groove 60 extends from the lateral side 22 across the longitudinal midline LM and ends just before the rounded base 34. A centerline 62 of the flex groove 60 is parallel with a center axis 64 of the notch 28 (i.e., a center axis of the rounded base 34). The flex groove 60 is a recess in the ground-facing surface 21. The flex groove 60 and the notch 28 both increase flexibility and decrease bending stiffness of the forefoot portion 14 during dorsiflexion at flex angles less than the first predetermined flex angle A1 (i.e., when the notch 28 is open) relative to a sole plate without the groove 60 and without the notch 28 in the side wall 26.

Traction elements 69 are shown in phantom in FIG. 2. The traction elements 69 may be integrally formed as part of the sole plate 12 (e.g., if the sole plate is an outsole or a unisole plate), may be attached to the sole plate 12, or may be formed with or attached to another plate underlying the sole plate 12, such as if the sole plate 12 is an inner board plate and the sole structure 10 includes an underlying outsole. For example, the traction elements 69 may be integrally formed cleats. In other embodiments, the traction elements may be, for example, removable spikes. The traction elements 69 protrude below the ground-facing surface 21 of the sole plate 12. Direct ground reaction forces on the sole plate 12 that could affect opening and closing of notch 28 are thus minimized. In other embodiments, however, the sole structure 10 may have no traction elements 69, the ground-facing surface 21 may be the ground-contact surface, or other plates or components may underlie the sole plate 12.

FIGS. 8-13 show an alternative embodiment of a sole structure 110. The sole structure 110 is alike in many aspects to the sole structure 10 of FIG. 1, and like reference numbers are used to denote like features. The sole structure 110 has a sole plate 112 that may be an inner board plate, an outsole plate, a midsole plate, combinations thereof, or a unisole plate. The sole plate 112 has two notches 128 in a medial side wall 126, and two notches 128 in a lateral side wall 148. In other words, the medial side wall 126 has a first notch (the more rearward notch 128) and a second notch (the more forward notch 128) spaced apart from the first notch 128, and the lateral side wall 148 has two notches 128 spaced apart from one another. The notches 128 are in the forefoot portion 14 of the sole plate 112. The side wall 126 forms a tab 133 between the spaced notches 128, and the side wall 148 also forms a tab 133 between the spaced notches 128. The tab 133 and notches 128 are positioned to be directly laterally outward of a wearer's metatarsal-phalangeal joints based on population averages for the particular size of footwear.

Each notch 128 extends downward toward the foot-facing surface 120 from an upper periphery 127 of the side walls 126, 148. The notches 128 are configured to be open when the forefoot portion 14 of the sole plate 112 is dorsiflexed in the first portion of a flexion range FR1 and closed when the forefoot portion 14 of the sole plate 112 is dorsiflexed in a second portion of the flexion range FR2 greater than the first portion FR1. The first portion of the flexion range FR1, the second portion of the flexion range FR2, and the predetermined flex angle A1 may be the same as those illustrated in the plot of FIG. 7, or may have different numerical values. For example, the predetermined flex angle is the sum of the angles formed between the forward face 130 and the rearward face 132 of the notches 128 in the medial side wall 126, which are configured to be identical to one another and to the angles between the identical forward faces 130 and rearward faces 132 of the notches 128 in the lateral side wall 148. If the first predetermined flex angle A1 of the sole plate 12 has the same numerical value as that of the sole plate 112, then the angle formed between the faces 30, 32 of the sole plate 12 would be equal to the sum of the angles between the faces 130, 132 on the medial side wall 126 of the sole plate 112. If the sole plate 112 is configured so that the sum of the angles of the notches 128 on the medial side wall 126 (i.e., between the forward face 130 and the rearward face 132 of each notch 128 on the medial side wall 126) is not the same as the sum of the angles of the notches on the lateral side wall 148 (i.e., between the forward face 130 and the rearward face 132 of each notch 128 on the lateral side wall 148), then whichever sum is lower determines the first predetermined flex angle, as those notches would close first.

Figure 9:
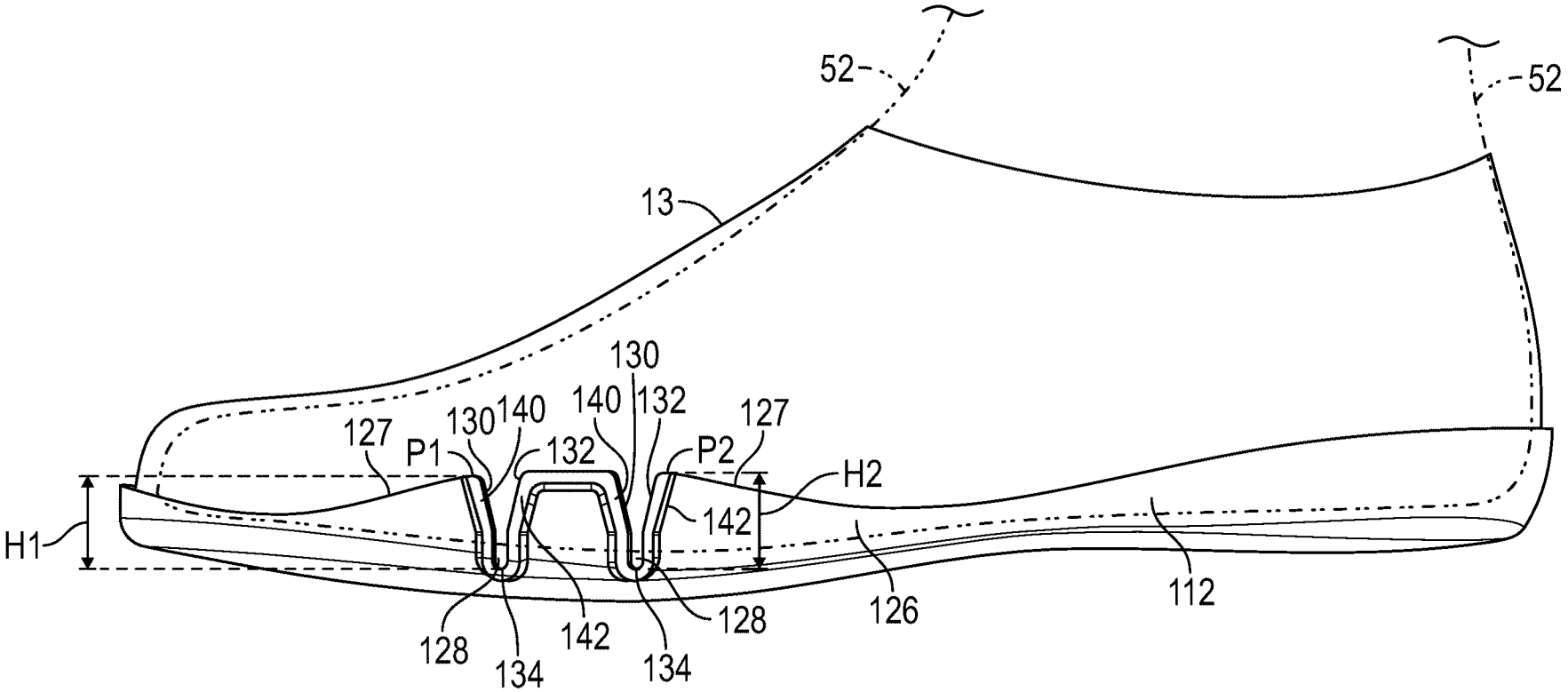
FIG. 9 is a schematic illustration in medial side view of the sole structure of FIG. 8 with an upper and showing a foot in phantom.
Figure 13:
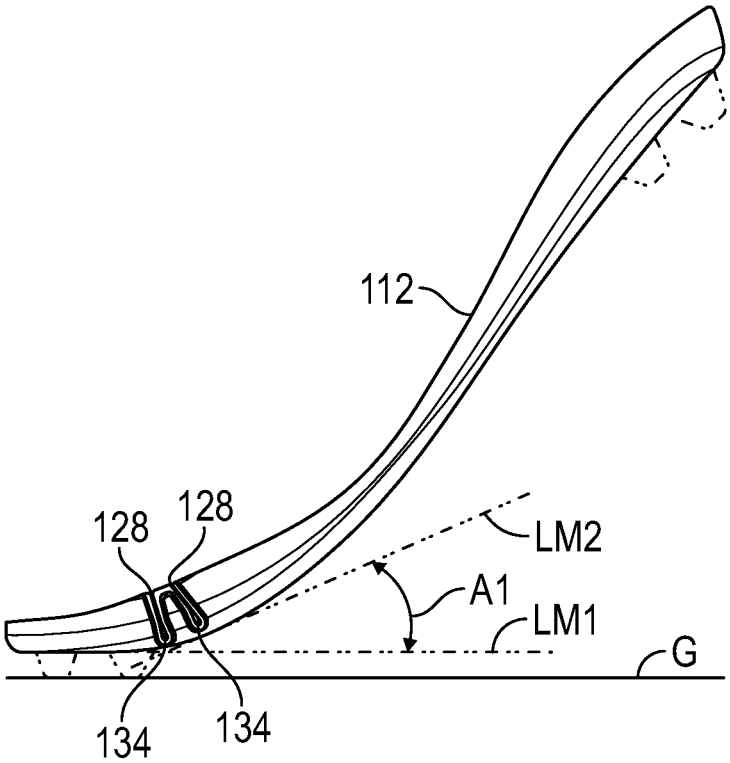
FIG. 13 is a schematic illustration in medial side view of the sole structure of FIG. 8 flexed at a first predetermined flex angle.

With reference to FIG. 9, the forward faces 130 incline in a forward direction, and at least a portion of the rearward faces 132 incline a rearward direction. The forward face 130 and the rearward face 132 of each notch 128 are non-parallel and spaced apart from one another when the sole structure 110 is in an unflexed, relaxed state, as shown in FIG. 9. The forward face 130 and the rearward face 132 of each notch 128 are parallel and in contact with one another when the sole structure 110 is dorsiflexed (i.e., flexed in the longitudinal direction) to at least the first predetermined flex angle A1, as illustrated in FIG. 13. A rounded base 134 connects the forward face 130 and the rearward face 132 at each notch 128. The rounded base 134 is configured to remain open both when the notches 128 are open (FIG. 9), and when the notches 128 close during dorsiflexion of the forefoot portion 14 as described herein (i.e., when the forward face 130 and the rearward face 132 contact each other, as shown in FIG. 13).

Figure 11:
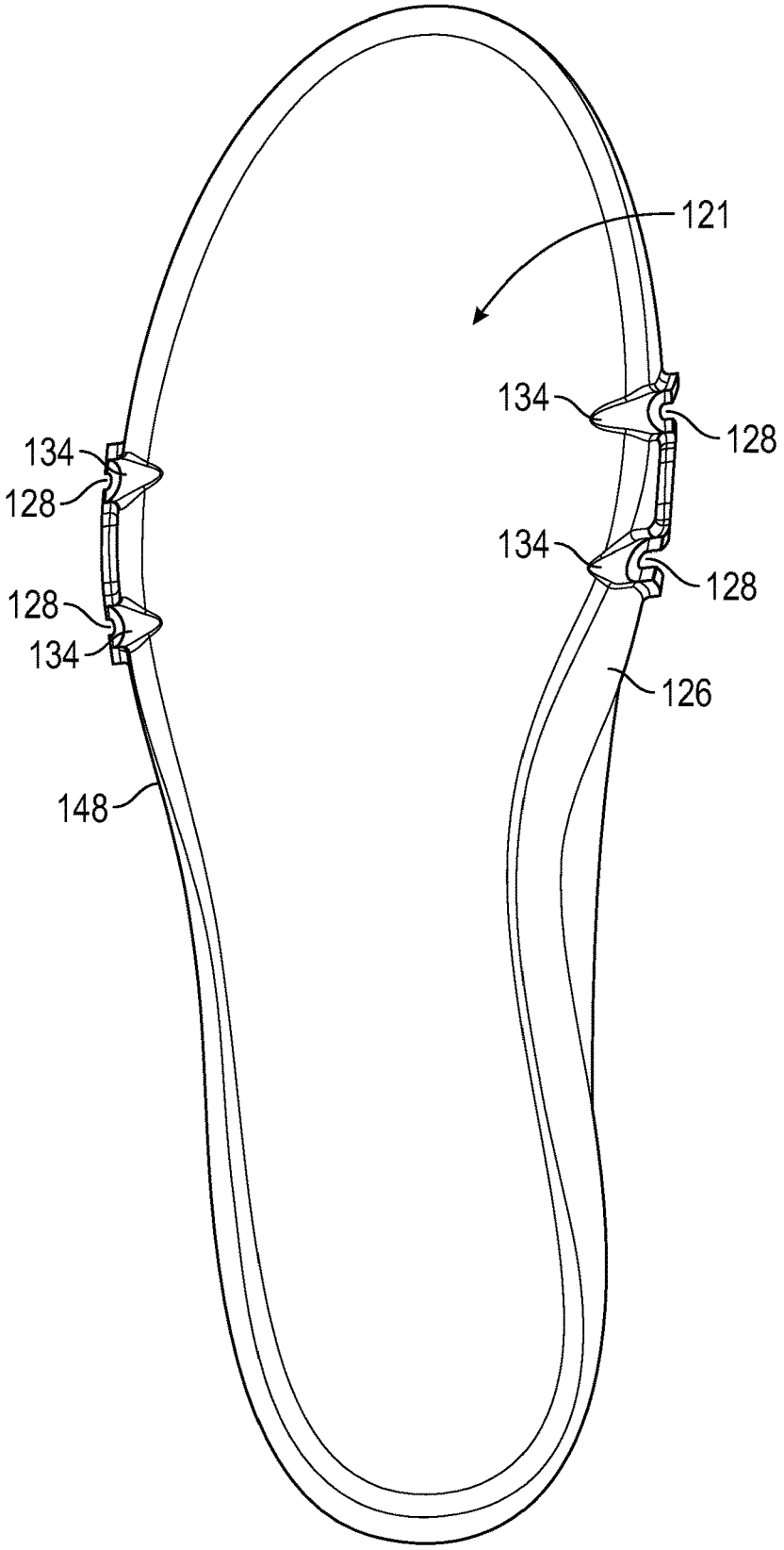
FIG. 11 is a schematic illustration in bottom view of the sole structure of FIG. 9.
Figure 12:
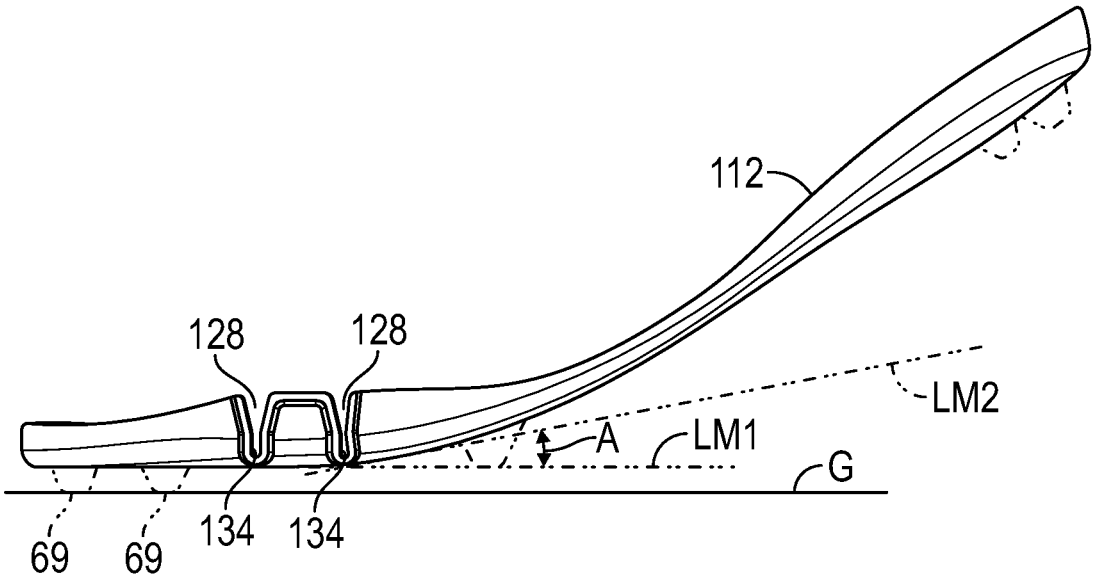
FIG. 12 is a schematic illustration in medial side view of the sole structure of FIG. 8, flexed in a first portion of a range of flexion.

FIG. 11 shows that the ground-facing surface 121 opposite to the foot-facing surface 120 does not include the flex groove 60 of FIG. 4. Alternatively, one or more flex grooves similar to flex groove 60 could be included on the ground-facing surface 121.

Figure 8:
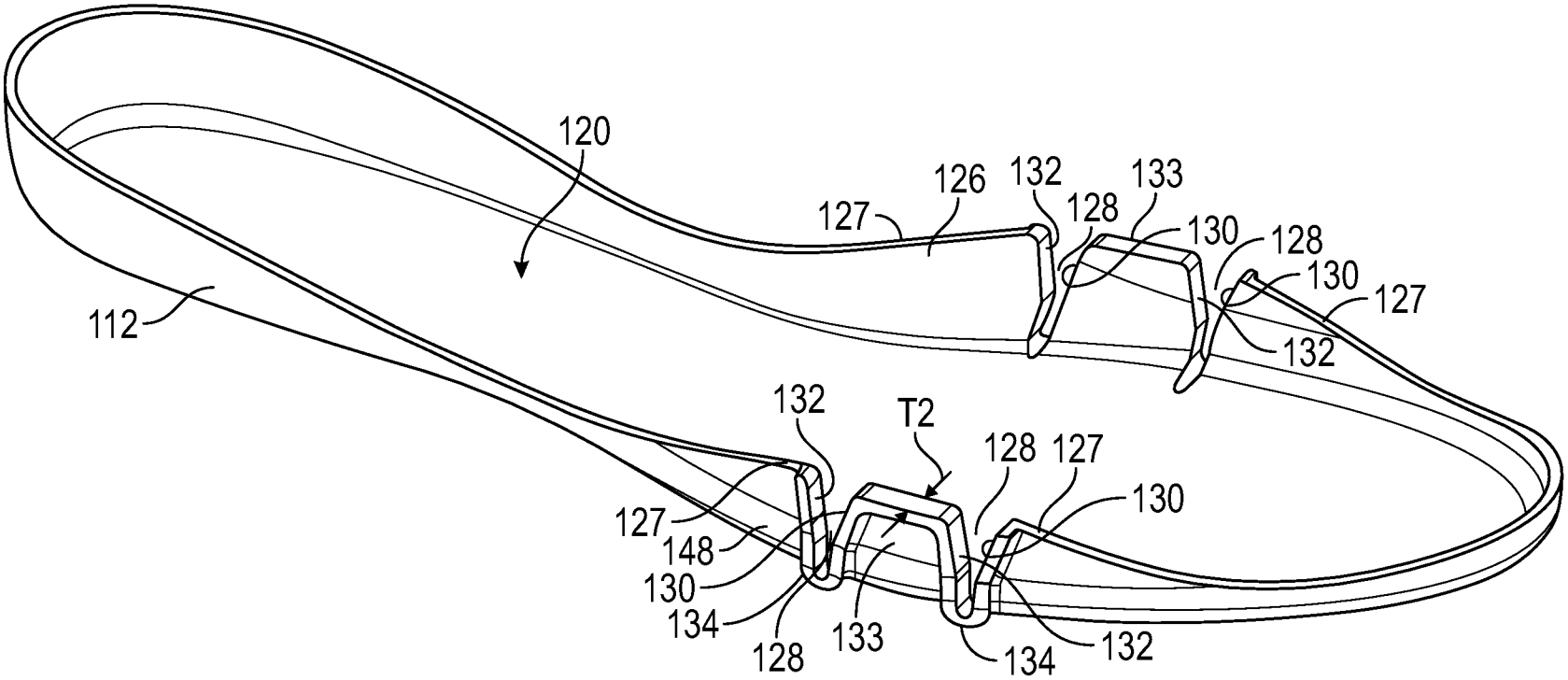
FIG. 8 is a schematic perspective illustration of a second embodiment of a sole structure for an article of footwear in accordance with an alternative aspect of the present teachings.
Figure 10:
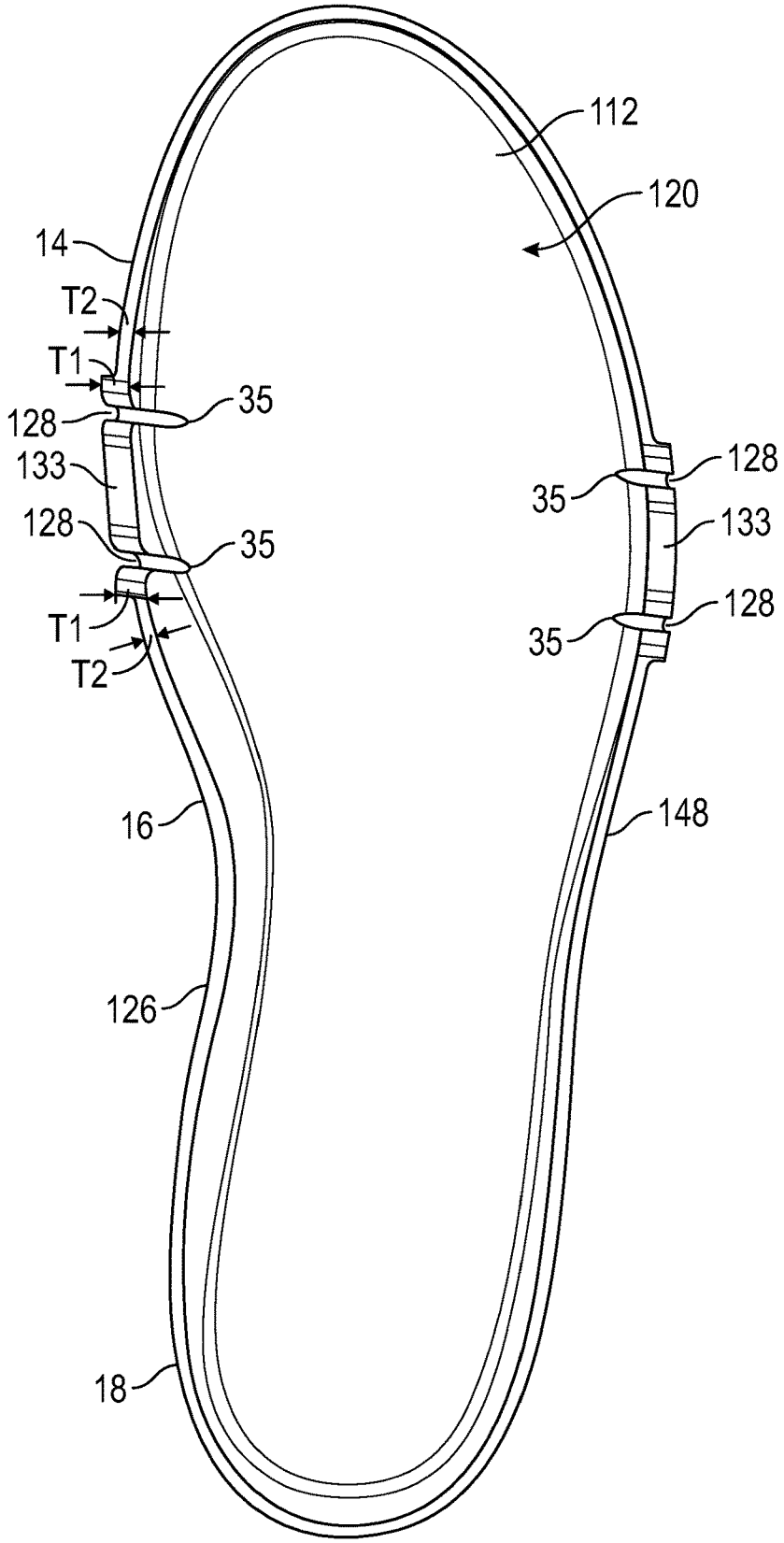
FIG. 10 is a schematic illustration in plan view of the sole structure of FIG. 8.

Similar to the sole plate 12, flanges 140,142 extend along the respective forward and rearward faces 130, 132 and are thicker than the adjacent side wall 126 or 148, respectively. The flanges 140, 142 are shown in FIG. 10 with a thickness T1 that is greater than a thickness T2 of the adjacent portion of the side wall 126. On both the side wall 126 and the side wall 148, the thickness of the upper periphery 127 along the tab 133 is also the same as the thickness T2, as best shown in FIG. 8.

The height of the side wall 126 and 148 at the tab 133, at the forward face 130 of the forward notch 128, and at the rearward face 132 of the rearward notch 128 on both side walls 126, 148 also promotes the function of the notches 128. The height of the forefoot portion 14 of the side wall 126 forward of the forward notch 128 is less than the height H1 at the notch 128, which is at a first peak P1 formed by the meeting of the forward face 130 with the upper periphery 127. The height of the forefoot portion 14 of the side wall 126 rearward of the notch 128 is less than the height H2 at the notch 128, which is at a second peak P2 formed by the meeting of the rearward face 132 with the upper periphery 127. The heights H1, H2 are measured from the bottom of the notch 128 at the base 134 to the respective peaks P1, P2. In the embodiment shown, the heights H1 and H2 are equal, and the tab 133 has the same height H1. The side wall 126 tapers in height from the first peak P1 in a forward direction, and tapers in height from the second peak P2 in a rearward direction. In the embodiment shown, the side wall 148 is configured with the same heights and peaks as side wall 126. Alternatively, the heights and peaks of the side wall 148 could be different than those of the side wall 126.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

What is claimed is:

1. A sole structure for an article of footwear comprising:
a sole plate that includes a forefoot portion with a foot-facing surface;
wherein:
the sole plate has at least one side wall extending upward from the foot-facing surface;
the at least one side wall has a notch in an upper periphery of the side wall in the forefoot portion;
the notch is configured to be open when the forefoot portion of the sole plate is dorsiflexed in a first portion of a flexion range and closed when the forefoot portion of the sole plate is dorsiflexed in a second portion of the flexion range greater than the first portion;
the notch has a forward face and a rearward face that are non-parallel and spaced apart from one another when the sole plate is in an unflexed, relaxed state, and that are parallel and in contact with one another when the sole plate is dorsiflexed in the second portion of the flexion range;
the notch has a rounded base disposed below the forward face and the rearward face and connecting the forward face and the rearward face; and
a distance across the notch from a lowest extremity of the forward face to a lowest extremity of the rearward face when the sole plate is in the unflexed, relaxed state is less than a distance across the notch at the rounded base below the lowest extremity of the forward face and the lowest extremity of the rearward face.

2. The sole structure of claim 1, wherein:
the first portion of the flexion range includes flex angles of the sole plate less than a first predetermined flex angle;
the second portion of the sole plate includes flex angles of the sole plate greater than or equal to the first predetermined flex angle; and
the sole plate has a change in bending stiffness at the first predetermined flex angle.

3. The sole structure of claim 1, wherein the forward face of the notch inclines in a forward direction, and the rearward face of the notch inclines in a rearward direction when the sole plate is in the unflexed, relaxed state.

4. The sole structure of claim 1, wherein:
the rounded base is open both when the forward face and the rearward face are non-parallel and spaced apart from one another and when the forward face and the rearward face are in contact with one another.

5. The sole structure of claim 1, wherein:
the notch is open at the rounded base in both the first portion of the flexion range and the second portion of the flexion range.

6. The sole structure of claim 1, further comprising:
a forward flange extending along the forward face;
a rearward flange extending along the rearward face; and
wherein the forward flange and the rearward flange are thicker than a portion of the at least one side wall adjacent the forward flange and the rearward flange.

7. The sole structure of claim 1, wherein the at least one side wall is at a medial side wall at a medial side of the sole plate and the notch is the only notch in the upper periphery of the medial side wall between a midfoot portion of the medial side wall and a foremost extent of the sole plate.

8. The sole structure of claim 1, wherein:
the sole plate has a ground-facing surface opposite from the foot-facing surface; and
the ground-facing surface includes a flex groove extending generally transversely in the ground-facing surface toward the notch.

9. The sole structure of claim 1, wherein:
the at least one side wall has at least one rib on a surface of the at least one side wall; and
the at least one rib extends generally downward from the upper periphery of the at least one side wall and is adjacent to the notch.

10. The sole structure of claim 1, wherein a height of a forefoot portion of the at least one side wall is greatest at the notch.

11. The sole structure of claim 1, wherein:
the at least one side wall has a first peak at the forward face of the notch and a second peak at the rearward face of the notch; and
the at least one side wall tapers downward in height from the first peak in a forward direction, and tapers downward in height from the second peak in a rearward direction.

12. The sole structure of claim 1, wherein the foot-facing surface of the sole plate has a groove that extends generally transversely from the notch.

13. The sole structure of claim 1, wherein the sole plate is an inner board plate, an outsole plate, a midsole plate, or a unisole plate.

14. A sole structure for an article of footwear comprising:
a sole plate that includes a forefoot portion with a foot-facing surface;
wherein:
the sole plate has at least one side wall extending upward from the foot-facing surface;
the at least one side wall has a first notch in an upper periphery of the at least one side wall in the forefoot portion of the sole plate;

the first notch includes a rounded base, a forward face and a rearward face, the rounded base disposed below the forward face and the rearward face and connecting the forward face and the rearward face, both of the forward face and the rearward face extending from the upper periphery to the rounded base, and the forward face and the rearward face being non-parallel and spaced apart from one another when the sole plate is in an unflexed, relaxed state;

the first notch is configured to be open between the upper periphery and the rounded base when the forefoot portion of the sole plate is dorsiflexed in a first portion of a flexion range and closed by contact of the forward face with the rearward face when the forefoot portion of the sole plate is dorsiflexed in a second portion of the flexion range greater than the first portion, such contact extending from the upper periphery to the rounded base;

a distance across the first notch from a lowest extremity of the forward face to a lowest extremity of the rearward face when the sole plate is in the unflexed, relaxed state is less than a distance across the first notch at the rounded base below the lowest extremity of the forward face and the lowest extremity of the rearward face; and the first notch is open at the rounded base in both the first portion of the flexion range and the second portion of the flexion range.

15. The sole structure of claim 14, wherein a ground-facing surface of the sole plate has a flex groove extending generally transversely in the ground-facing surface toward the first notch.

16. The sole structure of claim 14, wherein a height of a forefoot portion of the at least one side wall is greatest at the first notch.

* * * * *